US010926121B2

(12) United States Patent
Chattaway

(10) Patent No.: US 10,926,121 B2
(45) **Date of Patent: *Feb. 23, 2021**

(54) FIRE SUPPRESSION SYSTEMS

(71) Applicant: Kidde Graviner Limited, Colnbrook (GB)

(72) Inventor: Adam Chattaway, Old Windsor (GB)

(73) Assignee: KIDDE GRAVINER LIMITED, Berkshire (GB)

( * ) Notice: Subject to any disclaimer, the term of this patent is extended or adjusted under 35 U.S.C. 154(b) by 145 days.

This patent is subject to a terminal disclaimer.

(21) Appl. No.: 16/014,131

(22) Filed: Jun. 21, 2018

(65) Prior Publication Data

US 2018/0369627 A1 Dec. 27, 2018

(30) Foreign Application Priority Data

Jun. 22, 2017 (EP) ..... 17275090

(51) Int. Cl.

| | |
|---|---|
| ***A62C 99/00*** | (2010.01) |
| ***A62C 3/08*** | (2006.01) |
| ***A62C 3/00*** | (2006.01) |

(52) U.S. Cl.

CPC ..... *A62C 99/0018* (2013.01); *A62C 3/002* (2013.01); *A62C 3/08* (2013.01)

(58) Field of Classification Search

CPC .. A62C 3/002; A62C 3/07; A62C 3/08; A62C 35/68; A62C 37/36; A62C 37/44; A62C 99/0018

See application file for complete search history.

(56) References Cited

U.S. PATENT DOCUMENTS

| | | | | |
|---|---|---|---|---|
| 6,935,433 | B2 | 8/2005 | Gupta | |
| 9,033,061 | B2 | 5/2015 | Chattaway et al. | |
| 9,597,533 | B2 | 3/2017 | Seebaluck et al. | |
| 2006/0021652 | A1 * | 2/2006 | Surawski | B64D 37/32 137/209 |
| 2010/0236796 | A1 | 9/2010 | Chattaway | |
| 2011/0297401 | A1 | 12/2011 | Rennie et al. | |

OTHER PUBLICATIONS

Extended European Search Report for International Application No. 17275090.3 dated Dec. 6, 2017, 9 pages.

* cited by examiner

*Primary Examiner* — Darren W Gorman

(74) *Attorney, Agent, or Firm* — Cantor Colburn LLP

(57) ABSTRACT

A fire suppression system for an aircraft cargo compartment comprises a source of fire suppression agent and a supply line for conducting the fire suppression agent to the compartment. The supply line has one or more flow control valves arranged between the source and the cargo compartment. A controller controls the flow control valve to control the supply of fire suppression agent to the cargo compartment from the source.

20 Claims, 1 Drawing Sheet

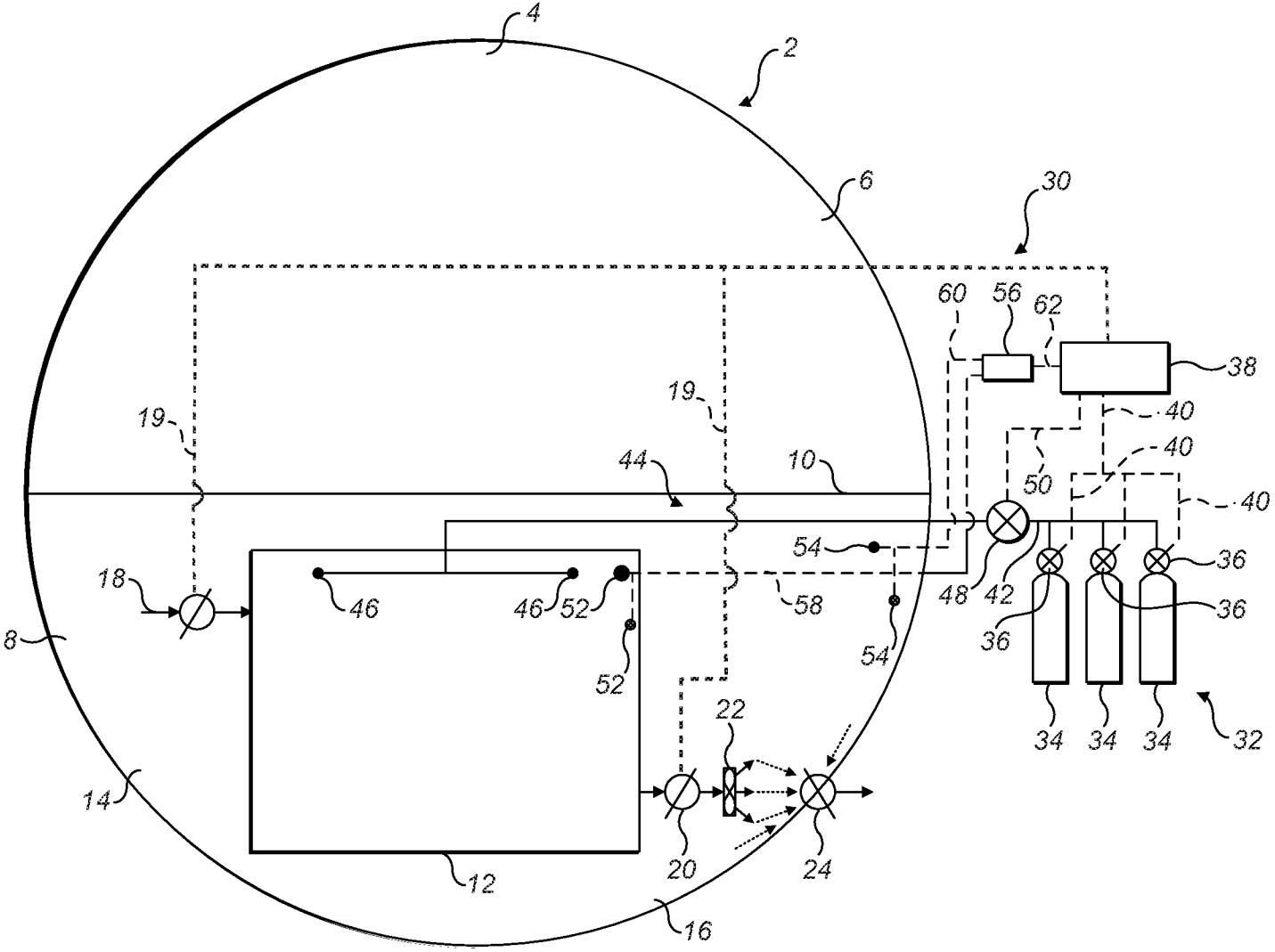
2
4
6
8
10
12
14
16
18
19
19
20
22
24
30
32
34
34
34
36
36
36
38
40
40
40
42
44
46
46
48
50
52
52
54
54
56
58
60
62

FIRE SUPPRESSION SYSTEMS

FOREIGN PRIORITY

This application claims priority to European Patent Application No. 17275090.3 filed Jun. 22, 2017, the entire contents of which is incorporated herein by reference.

TECHNICAL FIELD

The present disclosure relates to fire suppression systems and in particular to fire suppression systems for aircraft cargo compartments.

BACKGROUND

Aircraft are typically provided with fire suppression systems, for example for providing fire suppression in cargo compartments of the aircraft. Most of these systems use Halon 1301 as a suppression agent. However, Halon 1301 destroys the ozone layer and is therefore being phased out of use. For example, the European Union now requires the introduction of environmentally friendly suppression agents in new aircraft from 2019 onwards. All aircraft will have to be Halon-free by 2040. The Federal Aviation Authority and the aircraft industry have selected and tested a number of Halon replacement agents.

Most of these alternative agents require a significantly higher volumetric concentration of the agent in the protected area. For example, in some examples, a 42% as opposed to a 5% volumetric concentration may be required. Such high volumetric concentrations may lead to over pressurisation of the cargo compartment which may lead to damage within the compartment or wasteful venting of the suppression agent.

SUMMARY

From a first aspect, the disclosure provides a fire suppression system for an aircraft cargo compartment. The system comprises a source of fire suppression agent, a supply line for conducting the fire suppression agent to the compartment and one or more flow control valves arranged between the source and the cargo compartment. The system further comprises a controller for controlling the flow control valve to control the supply of fire suppression agent to the cargo compartment from the source through the supply line, at least one first pressure sensor for sensing the pressure within the cargo compartment and at least one second pressure sensor for sensing the pressure in an area within the aircraft, but external to the cargo compartment. The first and second pressure sensors are in communication with the controller which is controller configured so as to control said flow control valve to reduce the flow of fire suppression agent to the cargo compartment when at least one of a difference in the pressures sensed by the at least one first and second pressure sensors, a ratio of the pressures sensed by the first and second pressure sensors or a rate of change in a pressure increase measured by the first pressure sensor exceeds a respective predetermined value.

In certain embodiments, therefore, the controller may be configured so as to control the flow control valve to reduce the flow of fire suppression agent to the cargo compartment when the difference in the pressures sensed by the at least one first and second pressure sensors exceeds a respective predetermined value.

In certain embodiments, therefore, the controller may be configured so as to control the flow control valve to reduce the flow of fire suppression agent to the cargo compartment when the ratio of the pressures sensed by the first and second pressure sensors exceeds a respective predetermined value.

In certain embodiments, therefore, the controller may be configured so as to control said flow control valve to reduce the flow of fire suppression agent to the cargo compartment when the rate of change of pressure increase exceeds a respective predetermined value.

The first and second pressure sensors may be connected to a pressure analysis unit which provides a signal to said controller when the difference in the pressures sensed by the first and second pressure sensors, the ratio of the pressures sensed by the first and second pressure sensors or the rate of change in a pressure increase measured by the first pressure sensor exceeds the predetermined value.

In certain embodiments, therefore, the predetermined value may be approximately 500 to 1000 Pa.

In certain embodiments, the cargo compartment may comprise one or more valves in communication with the area external to the cargo compartment, said the valves operable in normal flight conditions to equalise the pressures in the cargo compartment and the area external to the cargo compartment and closable by the controller in the event of operation of the fire suppression system.

The at least one second pressure sensor may be provided in an area adjacent the cargo compartment, for example in a bilge area or cheek area of the aircraft fuselage.

The fire suppression system may comprise a plurality of first and second pressure sensors.

The controller may also be configured to reduce the flow the flow of fire suppression agent to the cargo compartment when the pressure sensed by the first pressure sensor exceeds a predetermined value.

The disclosure also provides a method of providing fire protection for an aircraft cargo compartment comprising supplying fire suppression agent to the cargo compartment from a fire suppression agent source, during the supplying, determining at least one of a difference between the pressure in the cargo compartment and an area within the aircraft but external to the cargo compartment, a ratio of the pressures in the cargo compartment and an area external to the cargo compartment or a rate of change of pressure in the cargo compartment and if the pressure difference, the ratio of the pressures or the rate of change in pressure exceeds a predetermined value, reducing the flow of fire suppression agent to the cargo compartment from the fire suppression agent source.

The predetermined value of pressure difference may be approximately 500 to 1000 Pa.

The method may comprise measuring the pressures within the cargo compartment and/or in the external area and establishing the pressure difference, ratio of pressures or rate of pressure increase therefrom.

The method may comprise measuring the pressures within the cargo compartment and/or in the external area by at least one or multiple sensors arranged in the respective cargo compartment and/or in the external area.

The area external to the cargo compartment may be adjacent to the cargo compartment, for example in a bilge area or cheek area of the aircraft fuselage.

The method may further comprise reducing the flow of fire suppression agent to the cargo compartment when the pressure within the cargo compartment exceeds a predetermined value.

BRIEF DESCRIPTION OF THE DRAWING

An embodiment of the disclosure will now be described, by way of example only, with reference to the accompanying drawings in which:

FIG. 1 is a schematic cross sectional view of an aircraft embodying a fire suppression system in accordance with this disclosure.

DETAILED DESCRIPTION

With reference to the FIGURE, an aircraft 2 comprises a fuselage 4 which includes an upper passenger compartment 6 and a lower compartment 8 separated from the passenger compartment 6 by a floor 10. A cargo compartment 12 is arranged within the lower compartment 8. One or more cargo compartments 12 may be provided in the aircraft, for example a forward and an aft cargo compartment 12. The lower compartment space 8 further has a bilge or keel area 14 below the cargo compartment 12 and cheek areas 16 to the sides of the cargo compartment 12.

The cargo compartment 12 comprises a first isolation valve 18 which may be selectively opened and closed by the controller 38 via a control line 19 and which, in its open position under normal flight conditions, permits flow of air between the cheek and bilge areas 14, 16 and the cargo compartment 12 so as facilitate equalisation in pressure in the cheek and bilge areas 14, 16 and the cargo compartment 12.

The cargo compartment 12 also comprises a second isolation valve 20 which may also be selectively opened and closed by the controller 38 via a control line 19. When open, in normal flight conditions, the second isolation valve 20 permits flow of air between the cheek and bilge areas 14, 16 and the cargo compartment 12 so as to facilitate equalisation of pressure in the cheek and bilge areas 14, 16 and the cargo compartment 12.

A fan 22 is coupled to an outlet of the second isolation valve 20 and is operable under normal flight conditions to ventilate of the cargo compartment 12. The outlet of the fan 22 discharges into the bilge area 16 in the vicinity of an outflow valve 24 which can vent excess pressure in the cheek and bilge area 14, 16 to atmosphere.

The cargo compartment 12 is provided with a fire suppression system 30. The fire suppression system 30 comprises a pressurised source 32 of a fire suppression agent such as argon, nitrogen, helium, carbon dioxide, heptafluoropropane or mixtures thereof. In this embodiment, the fire suppression agent is shown schematically as being stored in one or more pressurised canisters 34. The fire suppression agent is released from the canisters 34 in the event of operation of the fire suppression system. The release of fire suppression agent may be controlled by respective valves 36 connected to a controller 38 through signal or control lines 40. In some embodiments, the valves 36 may be flow control valves. In other embodiments, they may be simple on-off valves. In yet further embodiments, the valves may be hermetic diaphragms which may be ruptured, for example by an explosive charge in the event of system operation.

An agent supply line 42 leads from the canisters 34 to a distribution network 44 having, for example, one or more agent outlets 46 within the compartment 12. The distribution network 44 may be a low pressure network.

A flow control valve 48, for example a pressure regulating valve is arranged in the agent supply line 42 between the high pressure agent source 32 and low pressure distribution network 44. The flow control valve 48 is connected to the controller 38 via a signal or control line 50. The flow control valve 48 may reduce the flow of fire suppression agent from the agent source 32 to prevent or mitigate an excessive pressure build-up within the cargo compartment 12.

In addition to the flow control valve 48, a safety pressure relief valve (not shown) may be fluidly connected to the agent supply line 42 downstream of the flow control valve 48 and in fluid communication with the distribution network 44. The pressure relief valve may be configured to open above a pre-set pressure to relieve excessive pressure in the distribution network 44 to prevent damage to the cargo compartment 12. It may further be configured to close again once the pressure has returned to a safe value.

A first pressure sensor 52 is arranged within the cargo compartment 12 and measures the pressure therein. A second pressure sensor 54 is arranged in an area within the aircraft fuselage 4 but outside the cargo compartment 12. In particular, the second pressure sensor 54 may be arranged in an area external to but adjacent the cargo compartment 12. In this embodiment it is shown in the cheek area 16, although it may be placed elsewhere in the lower compartment 8, for example in the bilge area 14.

A plurality of first and second sensors 52, 54 may be provided at various positions within the cargo compartment 12 and the cheek/bilge areas 14, 16. This may be advantageous as it may provide a degree of redundancy in the event that one or more sensors are 52, 54 blocked or malfunctioning.

The first and second pressure sensors 52, 54 are connected to a pressure analysis unit 56 via respective lines 58, 60. The pressure analysis unit 56 provides to the controller 38 via a line 62 a signal indicative of an unacceptable pressure in the cargo compartment 12 based on the measured pressures. In one embodiment, the indication may be based on a difference in the pressures measured by the first and second pressure sensors 52, 54. In a further embodiment, the indication may be based on a ratio of the pressures measured by the first and second pressure sensors 52, 54. In a yet further embodiment, the indication may be based on a rate of change of the pressure measured by the first sensor 52. The pressure analysis unit 56 can be of any suitable design and can in some embodiments be part of the controller 38. For example, the unit 56 may be responsive to actual pressures received from the first and second sensors 52, 54 or to electrical signals from the sensors 52, 54.

Having described the structure of the system, its operation will now be described.

In the event of a fire being sensed in a cargo compartment 12, or in response to a command from a member of the aircraft crew, the controller 38 operates to open or rupture one or more of the valves 36 on the storage canisters 34 to release the fire suppression agent. The valves 36 may be opened or ruptured, for example, sequentially such that fire suppression agent is released successively from the storage canisters 34.

At the same time, the first and second isolation valves 18, 20 are closed thereby isolating the cargo compartment 12 from the cheek and bilge areas 14, 16. The fan 22 may also be stopped.

The controller 38 opens the control valve 48 to allow the fire suppression agent to flow into the distribution network 44.

To quickly suppress the fire, the initial flow rate of the fire suppression agent should ideally be high, since, as discussed above, the volumetric concentration of the fire suppression agent needs to be high. However, if too much fire suppression agent is supplied, the pressure within the cargo compartment 12 relative to that in the surrounding areas 14, 16 may rise to a value at which damage may be done to the cargo compartment 12, for example causing the cargo compartment 12 to rupture, which is clearly undesirable. It would also be wasteful of the fire suppression agent. This is not normally a problem using traditional fire suppressing agents, since the volume of the fire suppressing agent will be relatively small and over pressure within the cargo compartment 12 can be avoided by the intrinsic leakage of the cargo compartment 12. It may, however, be problematical using Halon free fire suppression agents where much higher volumes of agent will be required.

To mitigate this problem, in embodiments of the disclosure, the pressure differential between the cargo compartment 12 and the area external thereto is monitored by means of the pressure sensors 52, 54 and the pressure analysis unit 56. When a predetermined pressure differential is sensed, the pressure analysis unit 56 commands the controller 38 to operate the flow control valve 48 to reduce the flow of fire suppression agent into the cargo compartment 12. This allows for rapid initial supply of fire suppression agent, while at the same time mitigating damage to the cargo compartment liners 18 and wasting of fire suppression agent.

In alternative embodiments, rather than responding to the difference in pressure sensed in the cargo compartment 12 and the cheek and bilge areas 14, 16 the pressure analysis unit 56 and controller 38 may be responsive to a ratio of the respective measured pressures. Use of a pressure ratio as the basis for a control may be advantageous in that it may be used to drive a proportional controller to continuously optimise the flow of fire suppression agent to the cargo compartment 12 without compromising the integrity of the cargo compartment 12. It may also be advantageous in that the ratio may be less sensitive to altitude than a simple difference.

In a yet further embodiment, the pressure analysis unit 56 and controller 38 may be responsive to a rate of rise in the pressure measured in the cargo compartment 12.

The pressure differential, pressure ratio or rate of pressure rise at which the controller 38 will operate to reduce the flow will depend on the particular installation. However, typically, the controller 38 may operate to avoid a pressure differential exceeding 500 to 1000 Pa.

Once the pressure differential falls below the predetermined value, the controller 38 may command the flow control valve 48 to increase the flow of fire suppression agent once more.

In embodiments of the disclosure, the controller 38 may also be configured to operate the flow control valve 48 to reduce the flow of fire suppression agent into the cargo compartment 12 in the event that the absolute pressure measured within the compartment by the first pressure sensor 40 or sensors exceeds a predetermined value.

The above description is of an exemplary embodiment of the disclosure only. Modifications may be made to the disclosure without departing from the scope of the disclosure. For example, while a single flow control valve 48 is illustrated, more than one such valve may be provided. For example in embodiments where the valves 36 on some or all of the canisters 34 are flow control valves (as discussed above as being a possibility), the flow control valve 48 may be supplemented with, or replaced by, these flow control valves 36.

Also, the controller 38 may be responsive to multiple conditions, for example to pressure difference and pressure ratio, to pressure difference and rate of pressure rise, to pressure ratio and a rate of pressure rise, or to all three.

It will be understood from the above that the disclosure in its embodiments may provide the advantage of allowing a non Halon fire suppression agent to be used on an aircraft without potentially damaging the structure of the cargo compartment of the aircraft during supply of the fire suppression agent and reducing waste of the fire suppression agent.

The invention claimed is:

1. A fire suppression system for an aircraft cargo compartment, the system comprising:

a source of fire suppression agent; and a supply line for conducting the fire suppression agent to the compartment;

one or more flow control valves arrangeable between the source and the cargo compartment;

a controller for controlling the one or more flow control valves to control the supply of fire suppression agent to the cargo compartment from the source through the supply line;

at least one first pressure sensor for sensing the pressure within the cargo compartment; and at least one second pressure sensor for sensing the pressure in an area within the aircraft but external to the cargo compartment;

said at least one first and at least one second pressure sensors being in communication with said controller, said controller being configured so as to control said one or more flow control valves to reduce the flow of fire suppression agent to the cargo compartment when at least one of: (i) a ratio of the pressures sensed by the at least one first and at least one second pressure sensors, and (ii) a rate of change in a pressure measured by the at least one first pressure sensor, exceeds a respective predetermined value.

2. The fire suppression system of claim 1, wherein the controller is configured so as to control said one or more flow control valves to reduce the flow of fire suppression agent to the cargo compartment when a difference in the pressures sensed by the at least one first and at least one second pressure sensors exceeds a respective predetermined value.

3. The fire suppression system of claim 2, wherein the respective predetermined value for the difference in the pressures is approximately 500 to 1000 Pa.

4. The fire suppression system of claim 1, wherein the controller is configured so as to control said one or more flow control valves to reduce the flow of fire suppression agent to the cargo compartment when the ratio of the pressures sensed by the at least one first and at least one second pressure sensors exceeds a respective predetermined value.

5. The fire suppression system of claim 1, wherein the controller is configured so as to control said one or more flow control valves to reduce the flow of fire suppression agent to the cargo compartment when the rate of change of pressure exceeds a respective predetermined value.

6. The fire suppression system of claim 1, wherein the at least one first and at least one second pressure sensors are connected to a pressure analysis unit which provides a signal to said controller when the ratio of the pressures sensed by the at least one first and at least one second pressure sensors or the rate of change in a pressure increase measured by the at least one first pressure sensor exceeds the predetermined value.

7. The fire suppression system of claim 1, wherein the at least one first pressure sensor comprises a plurality of first pressure sensors and the at least one second pressure sensor comprises a plurality of second pressure sensors.

8. The fire suppression system of claim 1, wherein the controller is also configured to reduce the flow of fire suppression agent to the cargo compartment when the pressure sensed by the at least one first pressure sensor exceeds a predetermined value.

9. An aircraft comprising a cargo compartment and the fire suppression system of claim 1.

10. The aircraft of claim 9 wherein the cargo compartment comprises one or more valves in communication with the area external to the cargo compartment, said one or more valves operable in normal flight conditions to equalise the pressures in the cargo compartment and the area external to the cargo compartment and closable by the controller in the event of operation of the fire suppression system.

11. The aircraft of claim 9, wherein the at least one second pressure sensor is provided in an area adjacent the cargo compartment.

12. The aircraft of claim 9, wherein the at least one second pressure sensor is provided in a bilge area or cheek area of a fuselage of the aircraft.

13. A method of providing fire protection for an aircraft cargo compartment comprising:

supplying fire suppression agent to the cargo compartment from a fire suppression agent source;

during the supplying, monitoring at least one of: (i) a ratio of pressures in the cargo compartment and an area inside of the aircraft but external to the cargo compartment and (ii) a rate of change in pressure within the cargo compartment; and if at least one of the ratio of pressures or the rate of change in pressure exceeds a predetermined value, reducing the flow of fire suppression agent to the cargo compartment from the fire suppression agent source.

14. The method of claim 13, comprising measuring the pressures within the cargo compartment and in the area inside the aircraft but external to the cargo compartment and establishing ratio of pressures therefrom, or measuring the pressure within the cargo compartment and establishing the rate of change in pressure therefrom.

15. The method of claim 13, comprising measuring the pressures within the cargo compartment and in the area inside the aircraft but external to the cargo compartment by multiple sensors arranged in each of the respective cargo compartment and the area inside the aircraft but external to the cargo compartment.

16. The method of claim 13, wherein the area inside the aircraft but external to the cargo compartment is adjacent to the cargo compartment.

17. The method of claim 13, comprising measuring the pressure within the cargo compartment and establishing the rate of change in pressure therefrom.

18. The method of claim 13, wherein the area inside the aircraft but external to the cargo compartment is in a bilge area or cheek area of a fuselage of the aircraft.

19. The method of claim 13, comprising, during the supplying, monitoring a difference between the pressure in the cargo compartment and the area inside the aircraft but external to the cargo compartment and, if the pressure difference exceeds a predetermined value, reducing the flow of fire suppression agent to the cargo compartment from the fire suppression agent source.

20. The method of claim 19, wherein the predetermined value for the pressure difference is approximately 500 to 1000 Pa.

* * * * *